US009301658B1

(12) United States Patent
Boeltl

(10) Patent No.: US 9,301,658 B1
(45) Date of Patent: Apr. 5, 2016

(54) ADJUSTABLE CLOTHES HOOK

(71) Applicant: Acorn Engineering Company, City of Industry, CA (US)

(72) Inventor: Darryl Boeltl, Whittier, CA (US)

(73) Assignee: Acorn Engineering Company, City of Industry, CA (US)

( * ) Notice: Subject to any disclaimer, the term of this patent is extended or adjusted under 35 U.S.C. 154(b) by 0 days.

(21) Appl. No.: 14/545,592

(22) Filed: May 27, 2015

(51) Int. Cl.
*A47F 5/08* (2006.01)
*A47K 10/12* (2006.01)
*A47K 10/10* (2006.01)

(52) U.S. Cl.
CPC ..... *A47K 10/12* (2013.01); *A47K 10/10* (2013.01)

(58) Field of Classification Search
CPC ..... F16M 11/14; Y10T 403/32311; Y10T 403/32688; A47K 10/12; F16C 11/0604
USPC ..... 248/280, 282, 281, 283; 403/122, 123, 403/129, 90
See application file for complete search history.

(56) References Cited

U.S. PATENT DOCUMENTS

| | | | | | |
|---|---|---|---|---|---|
| 1,333,432 | A | | 3/1920 | Maier | |
| 2,298,176 | A | * | 10/1942 | Schwartz | 403/77 |
| 2,526,105 | A | * | 10/1950 | Adams | 464/115 |
| 3,204,898 | A | * | 9/1965 | Manning | 248/516 |
| 3,212,740 | A | * | 10/1965 | Greenberg | 248/514 |
| 3,319,982 | A | * | 5/1967 | Schwartz | 403/90 |
| 3,409,317 | A | * | 11/1968 | Richards | 403/138 |
| 3,625,553 | A | * | 12/1971 | Mattioli | 403/129 |
| 3,847,336 | A | | 11/1974 | Morris et al. | |
| 3,900,180 | A | | 8/1975 | McPhee | |
| 3,957,241 | A | | 5/1976 | Morris et al. | |
| 3,958,904 | A | | 5/1976 | Rusbach | |
| 4,740,804 | A | * | 4/1988 | Shands | 396/198 |
| 4,932,626 | A | | 6/1990 | Guillot | |
| 4,974,802 | A | * | 12/1990 | Hendren | 248/181.1 |
| 5,073,417 | A | * | 12/1991 | Bowerman | 428/31 |
| 5,098,213 | A | * | 3/1992 | Day | 403/7 |
| 6,017,010 | A | * | 1/2000 | Cui | 248/288.31 |
| 6,364,381 | B1 | * | 4/2002 | Schmidt et al. | 292/264 |
| 6,682,029 | B1 | * | 1/2004 | Dierkes | 248/165 |
| 7,131,616 | B2 | * | 11/2006 | Livingstone | 248/304 |
| 7,281,693 | B2 | | 10/2007 | Chou | |
| 2004/0234330 | A1 | * | 11/2004 | Slatter | 403/119 |
| 2006/0169858 | A1 | * | 8/2006 | Krueger | 248/304 |
| 2013/0062484 | A1 | * | 3/2013 | Murphy | 248/218.1 |

* cited by examiner

*Primary Examiner* — Joshua Rodden
*Assistant Examiner* — Kimberley S Wright
(74) *Attorney, Agent, or Firm* — William S. Ramsey

(57) ABSTRACT

Embodiments include, in combination with a ball joint relievable hanger having an moveable rod in which movement is facilitated by a ball portion within a complementary cavity, the ball portion having a bore containing a spring which bears on a locking member and urges the locking member into a detent in the complementary cavity, thereby retaining the rod in position unless a release weight is placed on the hanger, resulting in the downward movement of the rod, the improvement comprising, the extension of the bore in the ball portion to the end of the rod, a threaded screw which interacts with threads on the bore extension to allow distal-proximate movement of the screw, and seat means for conveying distal-proximate movement of the screw to the spring. Embodiments include means for adjusting the release weight of the relievable hanger.

8 Claims, 4 Drawing Sheets

ADJUSTABLE CLOTHES HOOK

BACKGROUND OF THE INVENTION

Field of the Invention

Embodiments pertain to devices which carry the weight of articles, in particular to those with a single joint adjustable bracket in which movement is facilitated by a spherical portion within a complementary cavity.

Embodiments find use in mental health and corrective institutions where fixed clothes hangers are sometimes used with a ligature to commit suicide or murder. Ball joint relievable hangers are known in the art. They have the disadvantage of not being capable of adjustment of the force which causes the bracket to break away. Embodiments of the present application have the advantages of being adjustable by maintenance personnel and are capable of mounting on a vertical surface such as a wall without requiring an aperture in the mounting surface.

The foregoing examples of the related art and limitations related therewith are intended to be illustrative and not exclusive. Other limitations of the related art will become apparent to those of skill in the art upon a reading of the specification and a study of the drawings.

BRIEF SUMMARY OF THE INVENTION

The following embodiments and aspects thereof are described and illustrated in conjunction with systems, tool and methods which are meant to be exemplary and illustrative, not limiting in scope. In various embodiments, one or more of the above-described problems have been reduced or eliminated, while other embodiments are directed to other improvements.

Embodiments include, in combination with a ball joint relievable hanger having an moveable rod in which movement is facilitated by a ball portion within a complementary cavity, the ball portion having a bore containing a spring which bears on a locking member and urges the locking member into a detent in the complementary cavity, thereby retaining the rod in position unless a release weight is placed on the hanger, resulting in the downward movement of the rod, the improvement comprising, the extension of the bore in the ball portion to the end of the rod, a threaded screw which interacts with threads on the bore extension to allow distal-proximate movement of the screw, and seat means for conveying distal-proximate movement of the screw to the spring in order to increase or decrease pressure on the spherical locking member into the detent cavity.

Embodiments include in combination with a ball joint relievable hanger having a body having a hemispherically-shaped depression therein, said depression having a pair of spaced detents therein, a hanger element comprising a ball-shaped member with a rod fixedly attached thereto and extending therefrom, said ball-shaped member being disposed in said depression in contiguous relationship to the wall forming said depression within said body and freely moveable therein The ball-shaped member further having a passageway with a single opening thereinto facing the wall forming said depression in said body, and compression biasing means disposed within said passageway in said ball-shaped member of said hanger element. There are retaining means for capturing said ball-shaped member within said depression, a locking element disposed within said passageway in said ball-shaped member of said hanger and freely moveable therein, with one end of said locking element being disposed between said biasing means and said opening facing said depression and formed to be receivable into said detent, whereby said rod is locked into an upward position to form a hanger for towels and the like when said biasing means urges said one end of said locking element into said detent following alignment therewith. When a substantial weight is impressed upon said rod in said locked position, said locking element in said passageway within said ball-shaped member is urged into said passageway towards said biasing means and out of said detent thereby unlocking said ball-shaped member from its previously fixed position and allowing said rod to fall downwardly and permitting said substantial weight to fall freely therefrom. Said detents are lying along a vertical plane passing through the center of said ball-shaped member and being equally spaced above and below said center, whereby said hanger may be installed in either of two possible installation positions. The improvement comprises, the extension of the passageway in said ball-shaped member to the end of said rod distal to the ball-shaped member, a distal-proximate movable pin with coupling means on said pin surface which interact with coupling means on the surface of said passageway extension to allow distal-proximate movement of said pin. There are seat means for conveying distal-proximate movement of said pin to said biasing means to adjust the magnitude of said substantial weight required to unlock said ball-shaped member from its previously fixed position and allowing said rod to fall downwardly.

In addition to the exemplary aspects and embodiments described above, further aspects and embodiments will become apparent by reference to the drawings and by study of the following descriptions.

BRIEF DESCRIPTION OF THE SEVERAL VIEWS OF THE DRAWING(S)

DETAILED DESCRIPTION OF THE INVENTION

The disclosures of U.S. Pat. No. 3,957,241 are incorporated by reference herein.

In this disclosure the term "release weight" means the weight of an object hanging on an relievable hanger adequate to cause the rod or hanger portion to move and shed the object.

Figure 1:
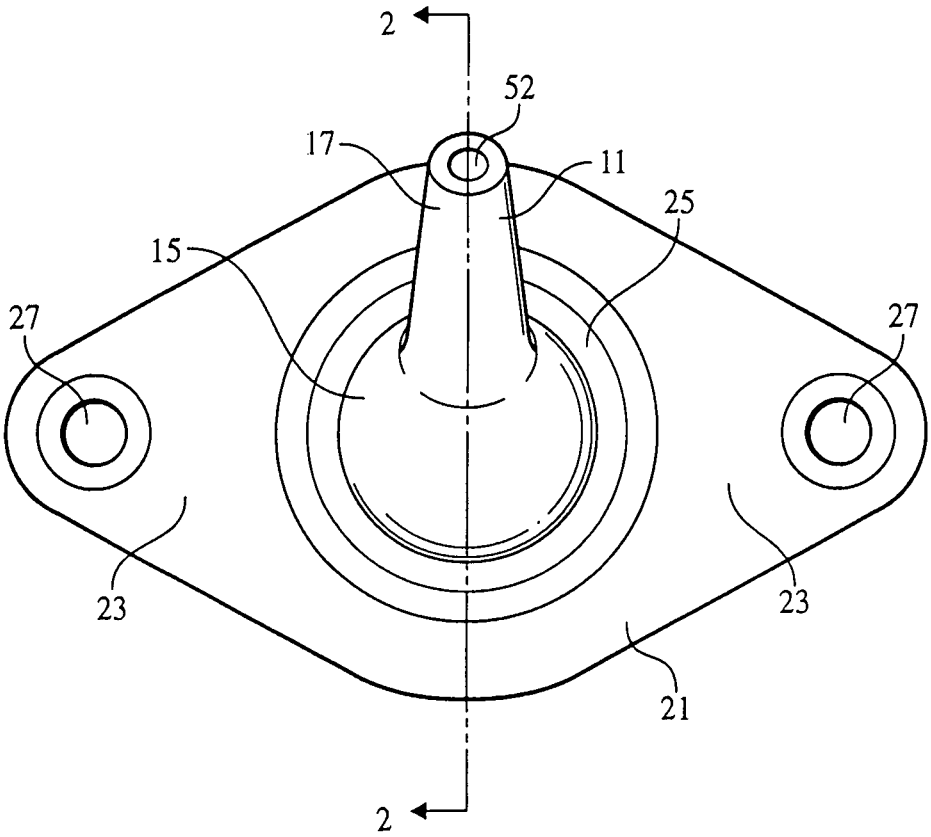
FIG. 1 is a plan view of an embodiment sheet-metal structure with mounted ball-and-rod element.

FIG. 1 is a plan view of an embodiment sheet-metal structure with mounted ball-and-rod element. Visible in FIG. 1 is the sheet metal structure or hook body 21. The hook body 21 has two apertured arms 23, each of which has holes or apertures 27. Hook body assembly bolts along with nuts are used to secure the hook body to a faceplate when a faceplate is used.

Also visible in FIG. 1 is the ball-and-rod element 11 comprised of a rod 17 with an adjustment bore 52 visible at the distal end. The rod 17 is integral with or attached to the ball 15 at the proximal end. A circular retaining ring or hook cap 25 is attached to the hook body 21 at the outer circumference and bears upon and retains the ball 15 in position at the inner circumference of the hook cap 25.

Figure 2:
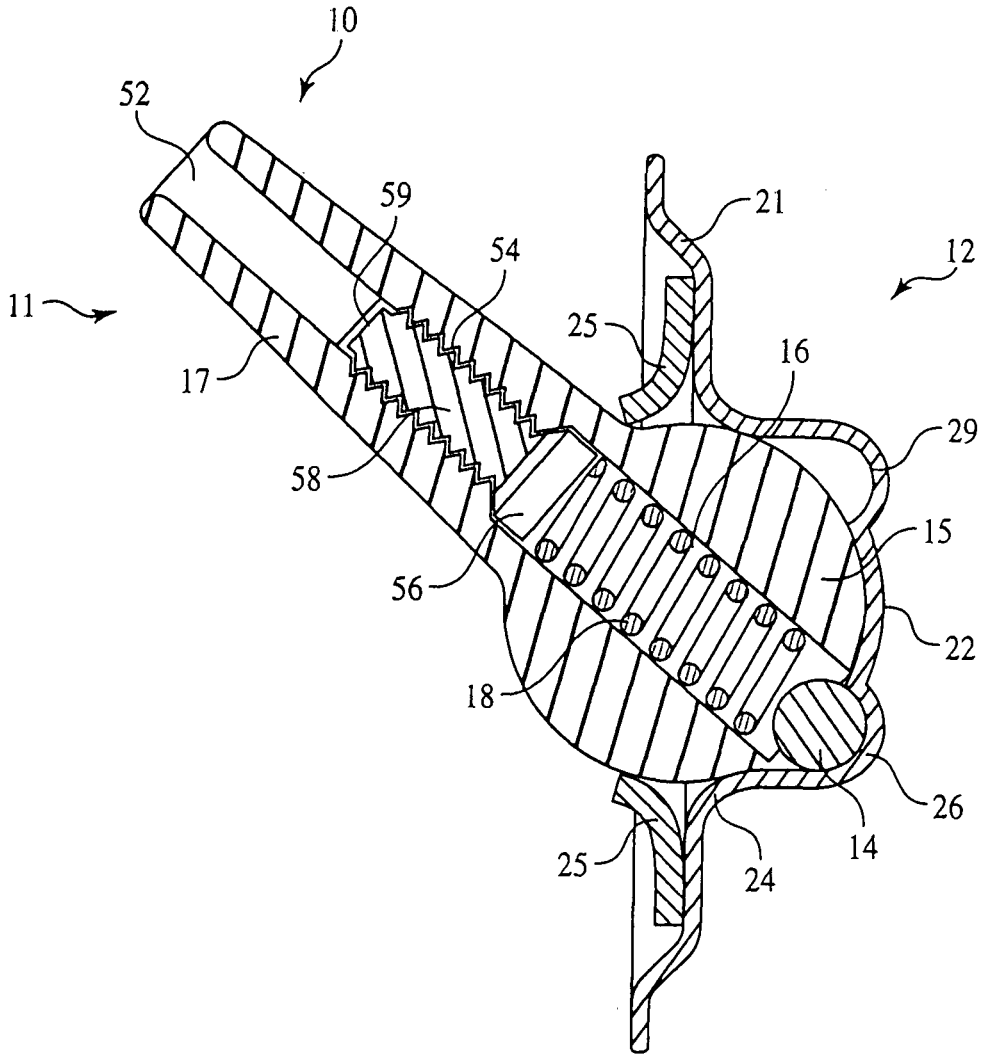
FIG. 2 is a cross-sectional view of the sheet-metal structure with mounted ball-and-rod element of FIG. 1 taken at line 2.

FIG. 2 is a cross-sectional view of the sheet-metal structure or hook body 21 with mounted ball-and-rod element 11 of FIG. 1 taken at line 2-2. The relievable hanger 10 comprises a ball-and-rod element 11, a socket 12 for the ball portion of the element 11, with at least one detent 26 and a spring biased locking member 14 for engagement with the detent 26.

The ball-and-rod element 11 further comprises a ball 15, a locking member 14, in this embodiment a spherical bearing, a bore 16 and a rod 17. A compression spring 18 is nested within the bearing bore 16. A locking member 14, in this embodiment a spherical bearing, is positioned inside the bore 16 with the spring 18 biasing the locking member 14 toward the outside of the ball. Although the locking member 14 is depicted here as a spherical bearing, other equivalent structures of this element, such as a rod with a rounded end, are specifically contemplated.

A socket 12 is formed by the combining of a sheet metal structure or hook body 21 having a hemispherical depression 22 therein and a pair of oppositely-disposed apertured arms 23 extending outwardly from the rim 24 of the hemispherical depression 22 and a ball retaining ring or hook cap 25. There is a lower detent 26 and an upper detent 29 on the inside of the hemispherical depression 22.

In use, when the rod 17 is in the upper position, as depicted in FIG. 2, the locking member 14 rests in the lower detent 26. When the release weight on the rod is exceeded, as by a ligature, the locking member 14 is forced up into the bearing bore 16, the ball 15 rotates until the movement of the rod 17 is stopped by the retaining ring 25, and the ligature which has exceeded the release weight falls off of the rod. The upper detent 29 allows installation of the hanger in either of two possible positions.

The present disclosure includes the improvement which allows adjustment of the spring compression in order to compensate for wear, age, or other conditions which may affect the degree of bias of the compression spring on the locking member and thereby affect the release weight. Such conditions may lower or raise the release weight, resulting in a hanger which fails to provide the desirable support for towels or clothes, or fails to release and confound a suicide attempt. The adjustment feature of the present disclosure will compensate for either an unwanted increase or decrease in the release weight. Furthermore, this feature allows adjustment of the release weight without requiring access to the back of the hanger or to the back of the wall as with hangers whose installation requires penetration of the wall.

Visible in FIG. 2 is the adjustment bore 52 which is an extension of the ball bore 16 through the rod 17. The adjustment bore has adjustment bore threads 54 on its inner surface. A threaded adjusting screw 58 interacts with the adjustment bore threads. Rotation of the adjustment screw causes it to move linearly through the adjustment bore. The proximal end of the adjustment screw bears on a circular disk-shaped spring seat 56 which, in turn, bears on the end of the compression spring 18. The distal end of the adjustment screw is terminated short of the end of the rod at approximately the middle of the rod. A security head 59 on the adjustment screw prevents unauthorized manipulation. Rotation of the adjustment screw in the clockwise direction causes movement of the screw in the proximal direction and increases compression of the compression spring 18 thereby increasing the release weight. Conversely, rotation of the adjustment screw in the counter-clockwise direction causes movement of the screw in the distal direction and reduces compression of the compression spring, thereby decreasing the release weight.

The use of an adjustment screw to alter an improper release weight has the advantage of allowing an infinite adjustment with a range of release weights. Such adjustments can be made from the user side of the installed hanger without removing the assembly from the wall. The hanger is vandal resistant because access to the adjustment screw is not obvious, because a special tool is required to adjust the load capacity, and because the threaded adjustment screw cannot be removed from the user side of the wall.

Figure 3:
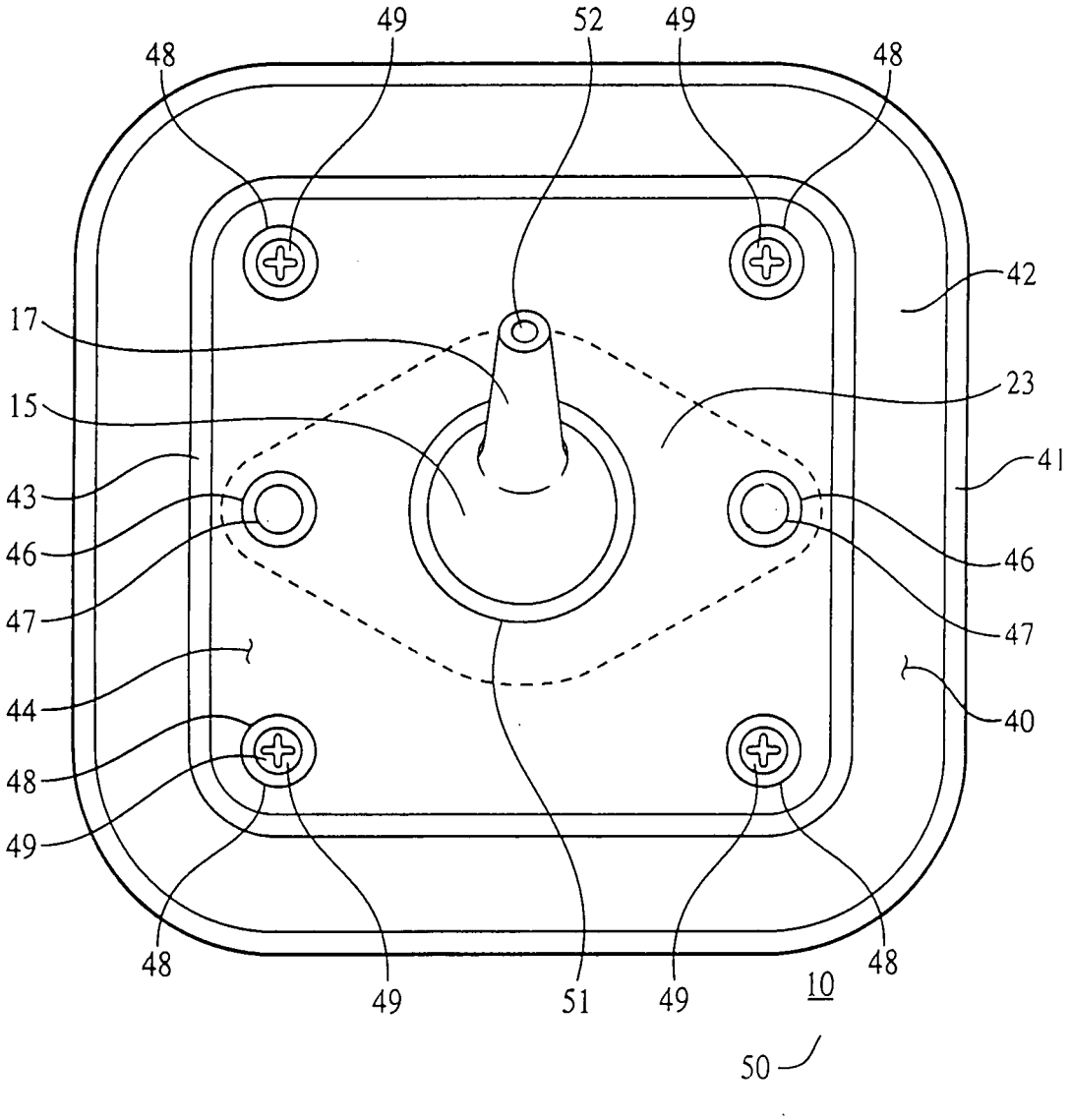
FIG. 3 is a plan view of an embodiment relievable hanger mounted on a wall with an embodiment faceplate.

FIG. 3 is a plan view of an embodiment adjustable relievable hanger 10 mounted on a vertical surface or wall 50 by an optional faceplate 40. Although an embodiment faceplate is shown in this disclosure, it is specifically contemplated that a variety of faceplates may be used with the sheet-metal structure, such as round, square, or rectangular faceplates, or no faceplate at all.

In the embodiment in FIG. 3, the approximately square faceplate 40 comprises flat faceplate rim 41 which surrounds and is attached to the bottom of a four-sided faceplate wall 42. The top side of the faceplate wall 42 is attached by a rounded shoulder 43 to an approximately square flat faceplate platform 44. The faceplate platform 44 and faceplate rim 41 are parallel to each other and to the wall 50. The faceplate walls 42 are at an angle of approximately 55° to the faceplate platform and to the faceplate rim. The faceplate walls are wide enough to accommodate a hanger 10 mounted behind the faceplate 40 without requiring a hole or depression in the wall 50. Four countersunk wall connector holes 48 are arrayed in the corners of the faceplate platform 44. A ball-and-rod element hole 51 is located approximately in the center of the faceplate platform 44 and hook body connector holes 46 are located at the sides of hole 51. Four wall mounting screws 49 with security heads are visible in FIG. 3. Two blind bolts 47 are used to connect the ball and rod element to the faceplate. The blind bolt heads are flat and cannot be turned from the front of the faceplate platform 44.

Use of this embodiment faceplate has the advantage of allowing installation of the hanger without requiring penetration through the wall or requiring access to the back of the wall.

Also visible in FIG. 3 is a ball 15 which protrudes through the hole 51 in the surface of the faceplate platform. Rod 17 with an adjustment bore 52 is attached to or integral with the ball. In FIG. 1 the rod 17 is in the upper position and is available as a hanger to support towels, clothes, hats, etc. The apertured arms 23 of the hook body are indicated by dashed lines in FIG. 3. Hook body assembly bolts 47 with security heads connect the hook body to the faceplate.

Figure 4:
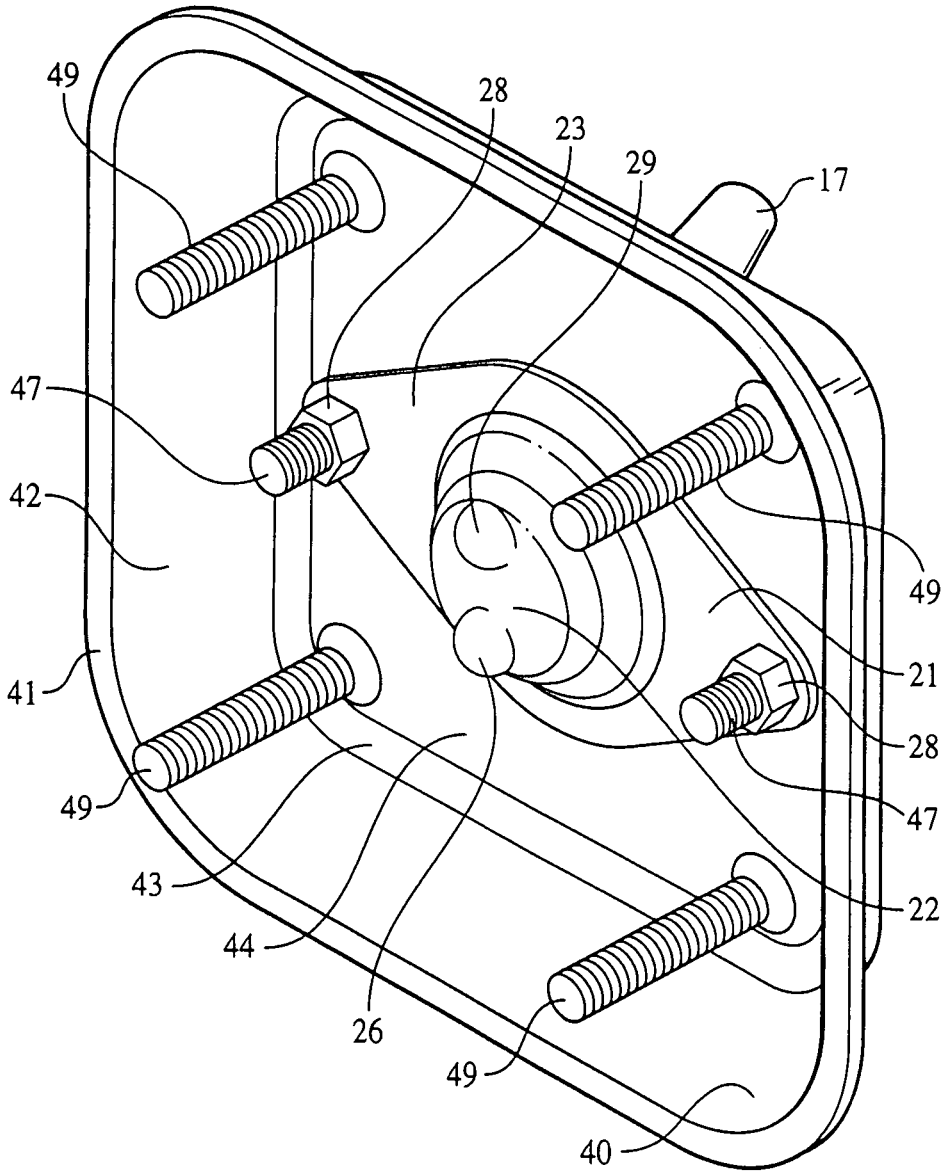
FIG. 4 is a perspective view of the back of an embodiment relievable hanger attached to an embodiment faceplate.

FIG. 4 is a perspective view of the back of an embodiment relievable hanger mounted on an embodiment faceplate. Visible in FIG. 4 is the back sides of the faceplate rim 41, faceplate wall 42, faceplate rounded shoulder 43, and faceplate platform 44. The four wall mounting screws 49 are visible in FIG. 4. Also visible are the back sides of some elements of the sheet metal structure or hook body 21. These include the hemispherically-shaped depression 22, apertured arms 23, lower detent 26 and upper detent 29. The hook body 21 is secured to the back of the faceplate platform 44 by two hook body assembly bolts 47 and secured by nuts 28. Also visible in FIG. 4 is the rod 17.

In embodiments, the faceplate is approximately 5.13 inches on each side. Each side of the platform is approximately 3.50 inches. The distance between the centers of the wall connector holes is approximately 2.75 inches. The length of the rod is approximately 1.42 inches and the diameter of the ball is approximately 0.95 inches. When installed on a vertical wall, the distance of the faceplate from the wall is approximately 0.89 inches.

In embodiments the release weight is variable or adjustable.

Embodiment adjustable releasable hangers may be manufactured of any suitably strong, resilient, and durable materials, such as iron, steel, aluminum, and plastics.

While a number of exemplary aspects and embodiments have been discussed above, those of skill in the art will recognize certain modifications, permutations, additions and sub combinations thereof. It is therefore intended that the following appended claims and claims hereafter introduced are interpreted to include all such modifications, permutations, additions and sub-combinations as are within their true spirit and scope. The applicant or applicants have attempted to disclose all the embodiments of the invention that could be reasonably foreseen. There may be unforeseeable insubstantial modifications that remain as equivalents.

I claim:

1. In combination with a ball joint relievable hanger having an moveable rod in which movement is facilitated by a ball portion within a complementary cavity, the ball portion having a bore containing a spring which bears on a locking member and urges the locking member into a detent in the complementary cavity, thereby retaining the rod in position unless a release weight is placed on the hanger, resulting in the downward movement of the rod, the improvement comprising, the extension of the bore in the ball portion to the end of the rod, a threaded screw which interacts with threads on the bore extension to allow distal-proximate movement of the screw, a security head on the threaded screw, and seat means for conveying distal-proximate movement of the screw to the spring.

2. The combination of claim 1 further comprising, faceplate means for mounting a ball joint relievable hanger on the surface of a wall without requiring an aperture in the wall.

3. The faceplate of claim 2 comprising a flat surface with one or more holes for mounting to the surface of a wall and with one hole for a ball-and-rod element.

4. The faceplate of claim 3 comprising a rim, walls, rounded shoulder, and a platform.

5. In combination with a ball joint relievable hanger having a body having a hemispherically-shaped depression therein, said depression having a pair of spaced detents therein, a hanger element comprising a ball-shaped member with a rod fixedly attached thereto and extending therefrom, said ball-shaped member being disposed in said depression in contiguous relationship to the wall forming said depression within said body and freely moveable therein, said ball-shaped member further having a passageway with a single opening thereinto facing the wall forming said depression in said body, compression biasing means disposed within said passageway in said ball-shaped member of said hanger element, retaining means for capturing said ball-shaped member within said depression, a locking element disposed within said passageway in said ball-shaped member of said hanger and freely moveable therein, one end of said locking element being disposed between said biasing means and said opening facing said depression and formed to be receivable into said detent, whereby said rod is locked into an upward position to form a hanger for towels and the like when said biasing means urges said one end of said locking element into said detent following alignment therewith and when a substantial weight is impressed upon said rod in said locked position, said locking element in said passageway within said ball-shaped member is urged into said passageway towards said biasing means and out of said detent thereby unlocking said ball-shaped member from its previously fixed position and allowing said rod to fall downwardly and permitting said substantial weight to fall freely therefrom, and said detents lying along a vertical plane passing through the center of said ball-shaped member and being equally spaced above and below said center, whereby said hanger may be installed in either of two possible installation positions, the improvement comprising, the extension of the passageway in said ball-shaped member to the end of said rod distal to the ball-shaped member, a distal-proximate movable pin with coupling means on said pin surface which interact with coupling means on the surface of said passageway extension to allow distal-proximate movement of said pin, a security head on the movable pin, seat means for conveying distal-proximate movement of said pin to said biasing means to adjust the magnitude of said substantial weight required to unlock said ball-shaped member from its previously fixed position and allowing said rod to fall downwardly.

6. The combination of claim 5 further comprising, faceplate means for mounting a ball joint relievable hanger on the surface of a wall without requiring an aperture in the wall.

7. The faceplate of claim 6 comprising a flat surface with one or more holes for mounting to the surface of a wall and with one hole for a ball-and-rod element.

8. The faceplate of claim 7 comprising a rim, walls, rounded shoulder, and a platform.

* * * * *